US005129372A

United States Patent [19]

Seiberth et al.

[11] Patent Number: 5,129,372

[45] Date of Patent: Jul. 14, 1992

[54] CUP TAPPET BODY FOR VALVE TAPPETS

[75] Inventors: Karl Seiberth, Remseck; Gotthard F. Wolf, Stuttgart, both of Fed. Rep. of Germany

[73] Assignee: GMB Giesserei & Maschinenbau Bodan AG, Switzerland

[21] Appl. No.: 542,254

[22] Filed: Jun. 21, 1990

[30] Foreign Application Priority Data

Jun. 24, 1989 [DE] Fed. Rep. of Germany ..... 3920729

[51] Int. Cl.[5] ..... F01L 1/24; F01L 1/14

[52] U.S. Cl. ..... 123/90.48; 123/90.51; 123/90.55

[58] Field of Search ..... 123/90.48, 90.51, 90.55, 123/90.58; 29/888.43

[56] References Cited

U.S. PATENT DOCUMENTS

| | | | |
|---|---|---|---|
| 4,230,491 | 10/1980 | Behnke | 123/90.51 |
| 4,367,701 | 1/1983 | Buente | 123/90.51 |
| 4,437,439 | 3/1984 | Speil | 123/90.55 |
| 4,530,320 | 7/1985 | Ferrero | 123/90.55 |
| 4,721,076 | 1/1988 | Goppelt et al. | 123/90.55 |
| 4,829,950 | 5/1989 | Kanamaru et al. | 123/90.51 |
| 4,907,330 | 3/1990 | Akao et al. | 123/90.51 |
| 4,909,198 | 3/1990 | Shiraya et al. | 123/90.48 |

FOREIGN PATENT DOCUMENTS

| | | | |
|---|---|---|---|
| 0085373 | 8/1983 | European Pat. Off. . | |
| 0030780 | 11/1985 | European Pat. Off. . | |
| 0225096 | 6/1987 | European Pat. Off. . | |
| 0267631 | 5/1988 | European Pat. Off. . | |
| 0196418 | 1/1989 | European Pat. Off. . | |
| 0355360 | 2/1990 | European Pat. Off. . | |
| 0389710 | 10/1990 | European Pat. Off. | 123/90.55 |
| 1093140 | 11/1960 | Fed. Rep. of Germany . | |
| 1526486 | 10/1976 | Fed. Rep. of Germany . | |
| 2747757 | 11/1978 | Fed. Rep. of Germany . | |
| 2754446 | 6/1979 | Fed. Rep. of Germany | 123/90.55 |
| 3239325 | 4/1984 | Fed. Rep. of Germany . | |
| 3519015 | 11/1986 | Fed. Rep. of Germany . | |
| 8506244 | 11/1986 | Fed. Rep. of Germany . | |
| 3630230 | 3/1988 | Fed. Rep. of Germany . | |
| 2829423 | 11/1988 | Fed. Rep. of Germany . | |
| 1185757 | 8/1959 | France | 123/90.55 |
| 62-45911 | 2/1987 | Japan . | |
| 8201034 | 4/1982 | World Int. Prop. O. . | |

OTHER PUBLICATIONS

Japanese Patent Abstract, No. 63-16107, *Patent Abstracts of Japan*, vol. 12, No. 212 (M-710) (3509), Jun. 17, 1988.

Japanese Patent Abstract, No. 62-63105, *Patent Abstracts of Japan*, vol. 11, No. 258 (M-618) (2705), Aug. 21, 1987.

*Primary Examiner*—Willis R. Wolfe
*Assistant Examiner*—Thomas N. Moulis
*Attorney, Agent, or Firm*—Barry R. Lipsitz

[57] ABSTRACT

To create a cup tappet body for valve tappets comprising a cylindrical guide body, a tappet bottom and an element carried by the tappet bottom for holding a valve support, which can be manufactured in as simple a way as possible from wear-resistant materials and is, therefore, inexpensive yet has good wear characteristics, it is proposed that the guide body and the tappet bottom be manufactured as an integral cast connection, and that the element holding the valve support be integrally connected as one piece with the tappet bottom and/or the guide body.

46 Claims, 5 Drawing Sheets

CUP TAPPET BODY FOR VALVE TAPPETS

Figure 1:
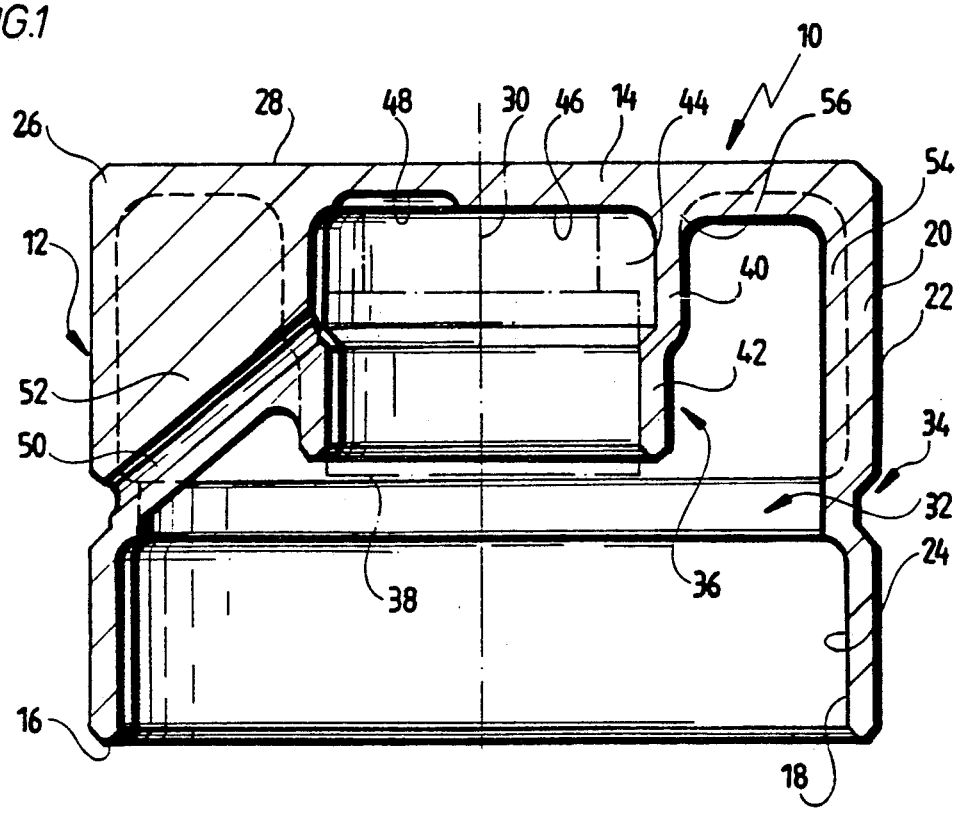

The invention relates to a cup tappet body for valve tappets comprising a cylindrical guide body, a tappet bottom and an element carried by the tappet bottom for holding a valve support.

Such cup tappet bodies are known. Herein, the element holding the valve support is either a guide cylinder for a hydraulic play-compensating element or a valve-supporting pin for valve tappets without hydraulic valve play compensation.

Such cup tappet bodies are mostly welded together from two semi-finished parts which are manufactured in a large number of forming or cutting steps.

Such manufacture of cup tappet bodies is expensive and involves a high degree of expenditure. A further disadvantage is that the forming or cutting is difficult when highly wear-resistant materials with good tribological characteristics are used. There is, however, in particular, in the case of cup tappet bodies for valve tappets with hydraulic valve play compensation, an increasing demand for such wear-resistant materials since there is no longer any play between cam and valve tappet when these are in operation and hence higher requirements with respect to wear have to be met.

The object underlying the invention is, therefore, to provide a cup tappet body which can be manufactured in as simple a way as possible from wear-resistant materials and is, therefore, inexpensive yet has good wear characteristics.

This object is accomplished in accordance with the invention by the guide body and the tappet bottom being manufactured as an integral cast connection and by the element holding the valve support being integrally connected as one piece with the tappet bottom and/or the guide body.

The great advantage of the inventive solution is that owing to the guide body and the tappet bottom being cast jointly, the cup tappet body can be manufactured very simply, in particular, for example, without any welding, but, at the same time, with excellent stability. The element holding the valve support can also be manufactured in a simple and stable manner jointly with the tappet bottom and/or with the guide body. Furthermore, with the inventive solution, the use of highly wear-resistant and, therefore, tribologically advantageous materials is possible.

Within the scope of the inventive solution, the term "manufactured by joint casting" is to be understood as either the entire cup tappet body being cast in one piece or at least parts of the cup tappet body being cast and thereby cast integrally on prefabricated parts so all of the parts making up the cup tappet body are joined together by the casting of parts of the cup tappet body integrally on the prefabricated parts.

In accordance with the basic concept underlying the invention, the element holding the valve support is integrally connected with the tappet bottom and/or with the guide body. In all cases where at least the guide body is cast, it is particularly advantageous for the element holding the valve support to be cast in one piece with the guide body. The tappet bottom can then be either prefabricated or likewise cast.

Alternatively, it is, however, also conceivable for the element holding the valve support to be cast in one piece with a part of the tappet bottom adjoining the element. In this case, the tappet bottom is then likewise cast in the course of the casting for joining all of the parts of the cup tappet body or it is also conceivable for the tappet bottom to be a prefabricated, cast part.

As explained above, the basic concept underlying the invention is that the individual parts of the cup tappet body are joined to form a single part by one part being cast integrally on the other parts. It is not specified which part is cast. It is, for example, possible to cast at least the tappet bottom and in the course of the casting of the tappet bottom to join together the other parts such as the guide body and, for example, the element holding the valve support. For manufacturing reasons, it is particularly advantageous for the guide body to be manufactured as casting in the course of the casting for joining guide body and tappet bottom so that at least the guide body is cast and the casting of the guide body results in the joining of all of the parts of the cup tappet body.

An advantageous variant of the above-described cup tappet body is characterized in that the guide body is cast integrally on the tappet bottom comprising a semi-finished part.

A further advantageous possibility of establishing a firm connection between the semi-finished part and the parts cast integrally thereon is to cast around regions of the semi-finished part, for example, to cast around at least sections of the element holding the valve support.

To establish a particularly firm and durable connection between the semi-finished part and the parts cast integrally thereon, provision is preferably made for the semi-finished part to be designed for integral casting on its cast-on side in a positively connected manner.

Insofar as the tappet bottom is prefabricated as semi-finished part in accordance with the invention, a preferred variant of the present invention makes provision for the element holding the valve support to be prefabricated with the tappet bottom as semi-finished part and so the guide body is cast integrally on this semi-finished part.

Alternatively, it is, however, also advantageous from a manufacturing viewpoint for the element holding the valve support to be cast in the course of the casting for joining guide body and tappet bottom, i.e., for the element holding the valve support to be cast integrally on the other parts.

In the simplest case in which all advantages with respect to the casting are gained, in particular, also with respect to the choice of the materials, provision is preferably made for the guide body, the tappet bottom and the element holding the valve support to be cast as a one-piece part.

In the embodiments described hereinabove, details were only given of the design of the indispensable parts of the cup tappet body. In particular when the tappet bottom is to be as light as possible with respect to weight, it is necessary for all of the parts to be constructed as light as possible, i.e., to be as thin-walled as possible. In this case, it is, for example, advantageous for the guide body to comprise a reinforcing element extending circumferentially in a plane parallel to the tappet bottom. This reinforcing element provides reinforcement for the guide body so the latter may be of thin-walled design.

This thin-walled design of the guide body may, for example, be implemented by the guide body having between the reinforcing element and the tappet bottom an undercut adjoining the reinforcing element.

The reinforcing element is preferably designed so as to protrude inwardly beyond an inner circumferential surface of the guide body.

In connection with provision of a reinforcing element on the guide body, it is likewise advantageous for the guide body to comprise, insofar as necessary, an oil groove on its outer circumferential surface at the level of the reinforcing element, with the reinforcing element and the oil groove then preferably together forming a bead in the guide body.

In principle, the reinforcing element may be arranged at any point on the cup tappet body. It is, for example, conceivable for the reinforcing element to be arranged at the bottom rim of the guide body so as to reinforce this free rim located opposite the tappet bottom, in particular for the final machining of the cup tappet body. It is, however, particularly advantageous for the reinforcing element to be arranged in a central region between the tappet bottom and a free rim of the guide body located opposite the tappet bottom as this arrangement of the reinforcing element provides sufficient reinforcement for the guide body and, for example, also offers the possibility of combining the reinforcing element with an oil groove arranged in the same region.

In principle, the reinforcing element could likewise be joined as prefabricated part with the other parts in the course of the casting. It is, however, particularly advantageous for the reinforcing element to be integrally connected with the guide body and hence in the case of a cast guide body it is cast in one piece with the latter.

To increase the stability of the cup tappet body according to the invention, it is, furthermore, advantageous for the guide body to comprise a reinforcing rib which is cast integrally on the guide body and extends in a plane parallel to its cylinder axis. Several reinforcing ribs spaced at identical angular distances from one another are preferably provided.

In principle, the reinforcing rib can be arranged with different orientations. In a simple solution which is advantageous as far as stability is concerned, the reinforcing rib extends in the radial direction in relation to the cylinder axis of the guide body.

Alternatively, it is, however, also conceivable within the scope of the invention, for the reinforcing rib to extend parallel to a tangential direction of the outer circumferential surface of the guide body.

In the embodiments of reinforcing ribs described hereinabove, it was not specified how far the reinforcing rib should extend in the cup tappet body. It is, for example, advantageous for the reinforcing rib to extend over the tappet bottom as far as to the element holding the valve support.

Furthermore, provision is made in a preferred embodiment for the reinforcing rib to extend from the reinforcing element over the inner circumferential surface of the guide body.

So far, no details were given as to the height of the reinforcing rib. It is, for example, expedient for the reinforcing rib to have a substantially constant height.

The reinforcing rib advantageously rises between the element holding the valve support and the inner circumferential surface of the guide body over the tappet bottom to at most approximately the level of the element holding the valve support.

It may also prove advantageous for the reinforcing rib to extend at the inner circumferential surface of the guide body from the tappet bottom to the reinforcing element or beyond the reinforcing element.

In a special embodiment of the reinforcing rib, provision is made for the latter to form a reinforcing triangle between the tappet bottom and the guide body and to be connected with both of these.

In principle, the reinforcing rib could engage only certain points on the part to be reinforced, for example, on the inner circumferential surface of the guide body or the tappet bottom. It is, however, particularly expedient for the reinforcing rib to rise over its entire length from the inner circumferential surface of the guide body in one piece with the latter. It is, furthermore, particularly favorable for the reinforcing rib to rise over its entire length from the tappet bottom in one piece with the latter.

In a further advantageous embodiment, provision is made in connection with the height of the reinforcing rib for the latter to rise from the tappet bottom and preferably also from the inner circumferential surface of the guide body by approximately the same height as the reinforcing element from the inner circumferential surface of the guide body.

As mentioned at the beginning, the element holding the valve support may differ greatly in design. In an advantageous embodiment, provision is made for the element holding the valve support to be a valve-supporting pin which rises from the tappet bottom.

Alternatively, in the case of cup tappet bodies for valve tappets with hydraulic valve play compensation, provision is made for the element holding the valve support to be a guide cylinder for a hydraulic valve play-compensating element.

The design of the guide cylinder still has to be described in greater detail. With a cup tappet body manufactured within the scope of the inventive technology, it is possible for the guide cylinder to be of radially extended design on the tappet bottom side so that it forms an oil chamber with the play-compensating element. An oil chamber for the hydraulic valve play-compensating element is thereby created in a simple way without, for example, as is customary in the prior art, additional parts having to be welded therein.

Insofar as necessary, the oil chamber can be expediently supplied by being provided with an oil duct extending towards the outer circumferential side of the guide body and advantageously opening into the oil groove.

In order not to have to create a new part through which the oil duct can be guided, it is expedient—particularly if the inventive cup tappet body is to be of as simple design as possible with respect to the manufacturing technique—for the oil duct to extend through a reinforcing rib which is advantageously of thickened configuration for accommodating the oil duct.

A variant which is highly advantageous, particularly as far as the mass of material is concerned, is characterized in that the guide cylinder forms a guide ring for the valve play-compensating element on its side remote from the tappet bottom and comprises between the guide ring and the tappet bottom a base ring of larger inside and outside diameter than the guide ring for carrying the guide ring so that the oil chamber is created between the base ring and the valve play-compensating element. With this construction, an oil chamber is created in a simple way, and it is of advantage for the thickness of the walls of the guide ring and the base ring to be substantially identical.

In all of the embodiments described hereinabove, reference was only made to the structural features of the cup tappet body. Within the scope of the invention, however, the features relating to the material have, in like manner, proven important.

An advantageous embodiment of the inventive cup tappet body, therefore, makes provision for the cast part of the cup tappet body to be made of cast iron.

The cast iron expediently comprises at least in the region of the tappet bottom a partially or completely metastably solidified structure. Such a cup tappet body is produced by, for example, a chilled casting or partially carbide casting. This embodiment is expedient for making the tribological characteristics of the tappet bottom which is contacted by the cam of a camshaft as advantageous as possible, i.e., as wear-resistant as possible and adapted to the material of the camshaft.

The cast iron may be thermally unhardened. It is, however, more expedient for the cast iron to be thermally or thermochemically hardened.

One possibility for hardening the cast iron is for the latter to be hardened by heat treatment with phase transition. As an alternative or in addition thereto, it is also possible to harden the cast iron by thermochemical rim zone hardening, for example, nitriding, nitrocarburizing or case-hardening. A further alternative or additional measure is for the cast iron to be hardened by remelt hardening.

As an alternative to the provision of cast iron, the inventive concept of a cup tappet body, in particular the joining of the parts thereof by casting, offers the possibility for the cast part of the cup tappet body to be cast from steel. As steel, case-hardening steel may, for example, be used. It may, however, also be tempering steel, nitriding steel, tool steel or high-speed steel. As a rule, all of these types of steel are impossible or extremely difficult to work on in a forming operation and also create difficulties in a cutting operation. However, the inventive concept of the joining by casting and the manufacture of these parts with an almost finished contour offers the possibility of also materials.

A further alternative to manufacturing the inventive cup tappet body from cast iron or steel is for the cast part of the cup tappet body to be cast from a light-metal alloy. This light-metal alloy is preferably an aluminum alloy or a titanium alloy.

To improve the mechanical characteristics, it is, furthermore, expedient for the light-metal alloy to be fiber- or whisker-reinforced.

Insofar as the inventive cup tappet body is not completely cast, but includes a semi-finished part, it is particularly expedient in accordance with the invention for the semi-finished part to be made of steel. These steel materials may be selected in accordance with the necessary tribological characteristics, in particular of the tappet bottom, and hence make it possible for simpler and less expensive materials to be used for those parts of the cup tappet body which are subjected to less wear. All of the steels mentioned hereinabove are suitable as steel materials.

As an alternative to the steel materials, it is conceivable for the semi-finished part to be made of ceramic material. The ceramic material also offers tribologically advantageous characteristics and, in addition, makes it possible for the other parts of the cup tappet body to be made of cheaper or simpler materials.

As third alternative, aside from the provision of steel materials and ceramic materials for the semi-finished part, a further advantageous embodiment is to be seen in the semi-finished part consisting of hard metal which is likewise advantageous in view of its characteristics, in particular for the tappet bottom.

Regarding the process for casting the inventive cup tappet body using the above-described materials, in order to join all of the parts thereof by casting, provision is expediently made for the cast part of the cup tappet body to be manufactured by shaped casting, preferably shaped casting with an almost finished contour so it only remains for the cup tappet body to be ground.

Various casting techniques are conceivable for producing the shaped casting with an almost finished contour. It is, for example, advantageous for the cast part of the cup tappet body to be manufactured by sand casting, precision casting, precision casting in ceramic molds, die-casting or pressure die-casting. Pressure die-casting is used, in particular, with light-metal alloys and preferably with aluminum.

As an alternative to the shaped casting, it is, however, also advantageous for the cast part of the cup tappet body to be manufactured by powder metal injection die-casting.

Aside from the above-described features of the cup tappet body itself, the object underlying the invention is also accomplished by a process for the manufacture of a cup tappet body for valve tappets with the above-mentioned features by the entire cup tappet body being cast with a substantially finished contour.

Alternatively, the object underlying the invention is also accomplished by a process for the manufacture of a cup tappet body for valve tappets by part of the cup tappet body being manufactured as semi-finished part and the cup tappet body being manufactured as compound casting by substantially-finished-contour casting of the other parts of the cup tappet body on the semi-finished part.

In both processes mentioned hereinabove as alternatives, it is simplest for the cup tappet body to be cast with a substantially finished contour as this is the simplest and least expensive procedure as far as casting is concerned.

Alternatively, however, if particularly high material demands are made on parts of the cup tappet body, it may prove advantageous for the cup tappet body to be completed by forming following the substantially-finished-contour casting.

In all of the processes described hereinabove, it is, furthermore, expedient for the cup tappet body to undergo final grinding to size, i.e., not to produce the contour, but merely to achieve accuracy of size.

Figure 2:
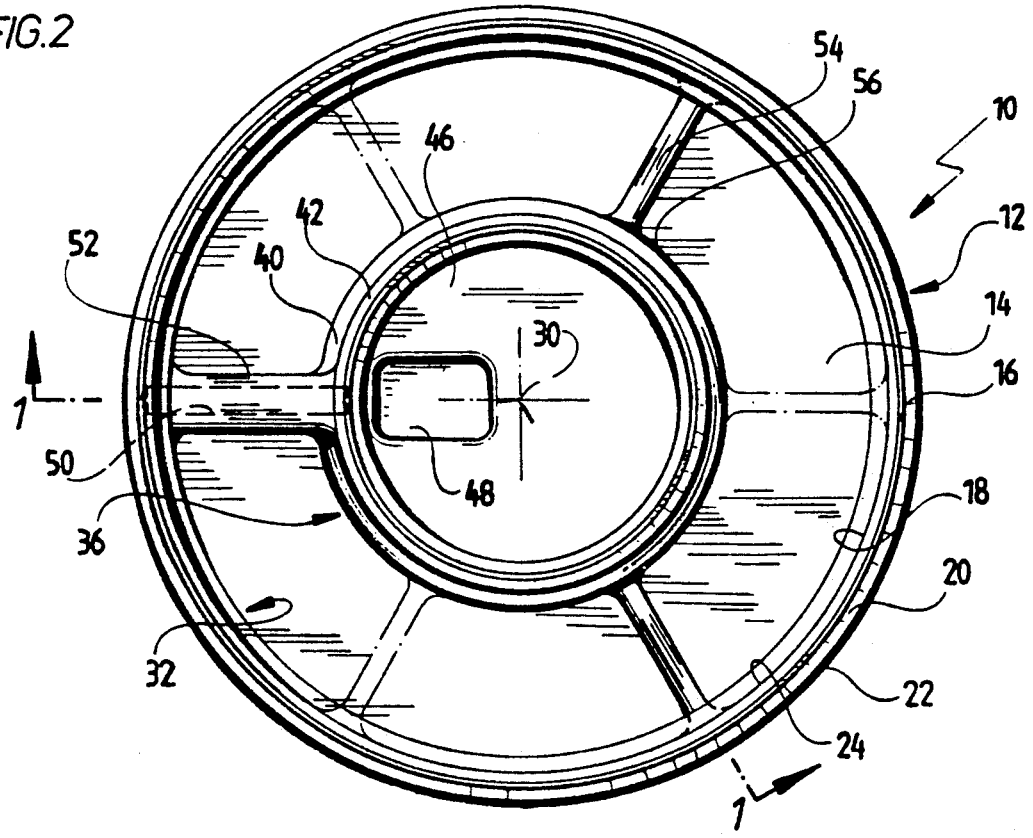
Figure 3:
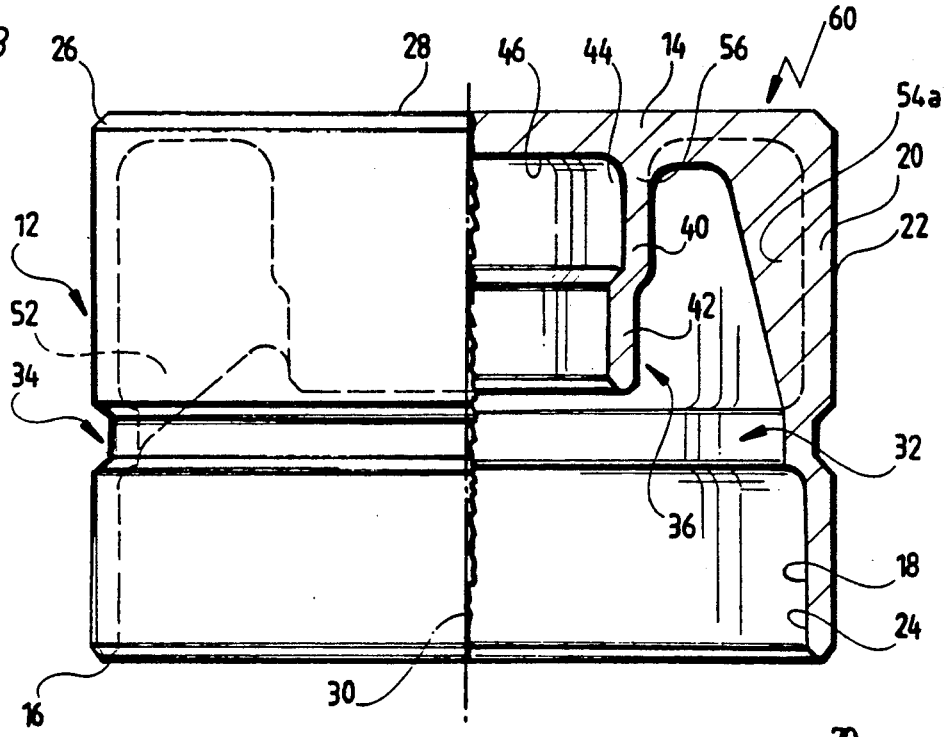
Figure 4:
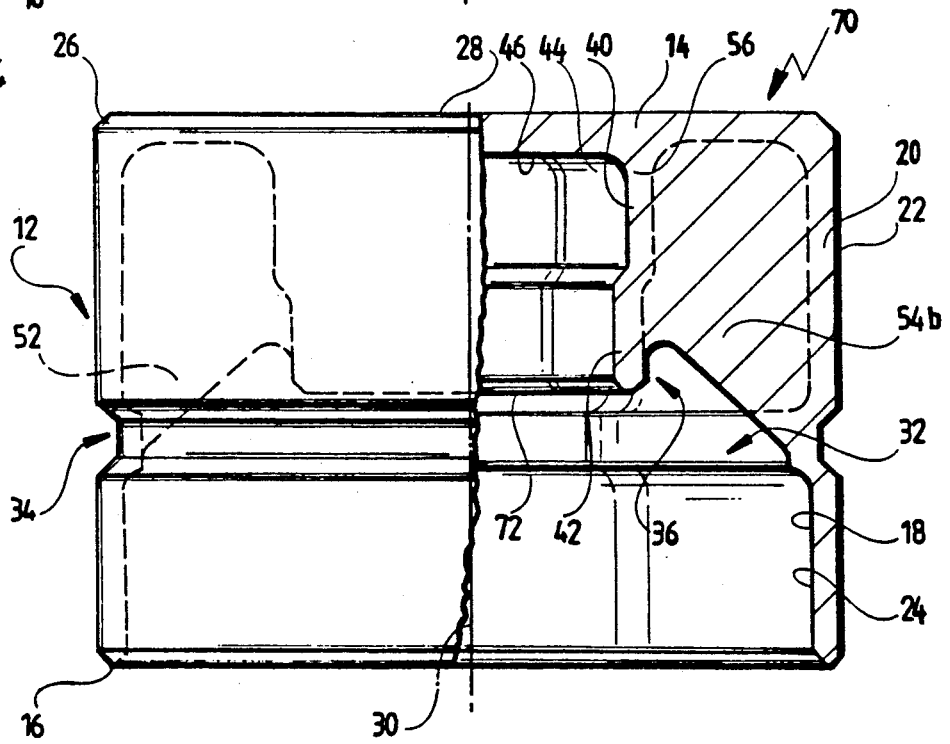
Figure 5:
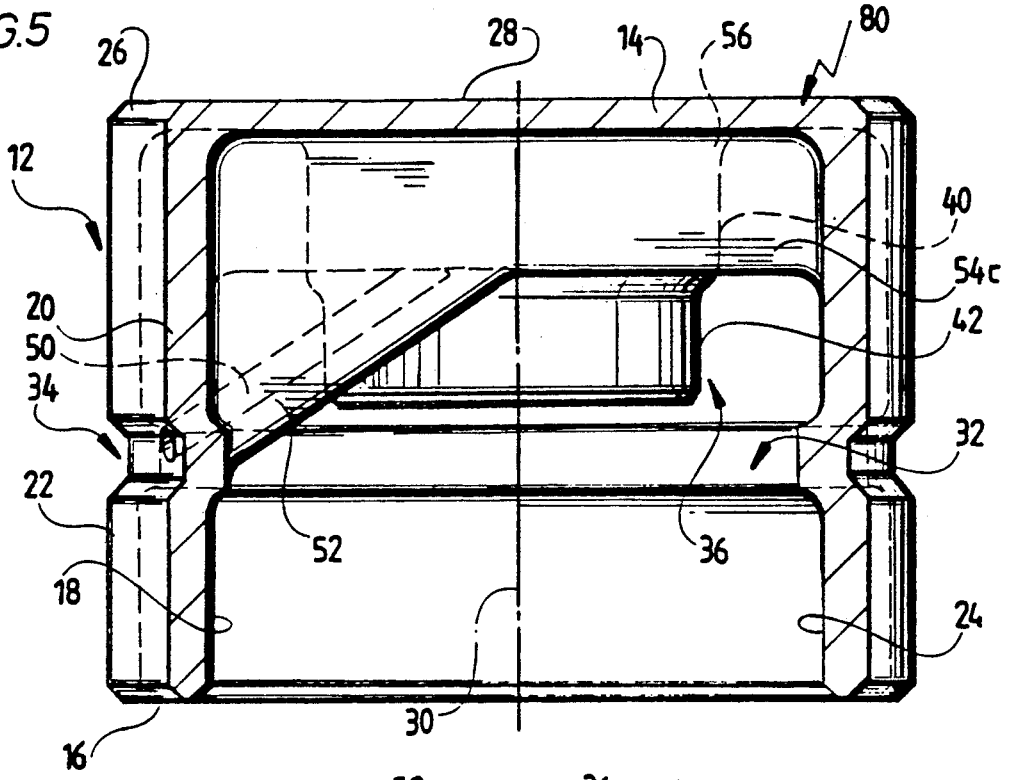
Figure 6:
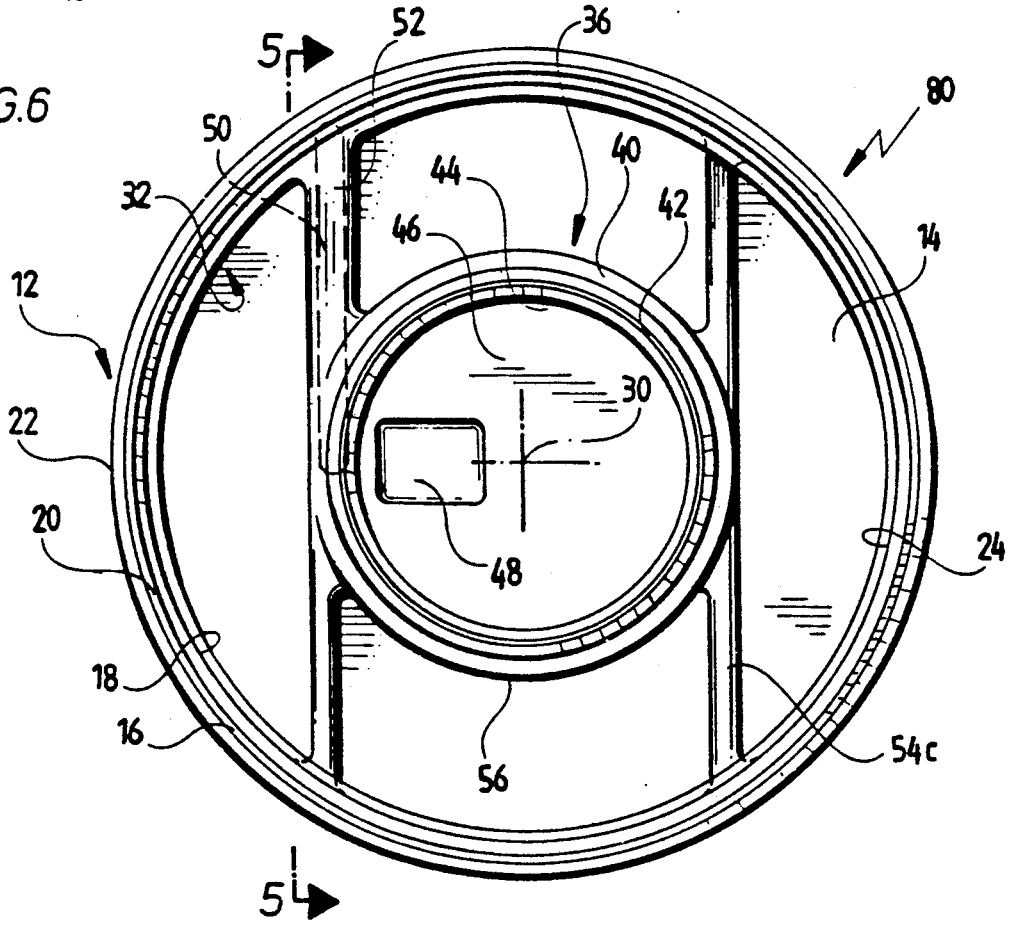
Figure 7:
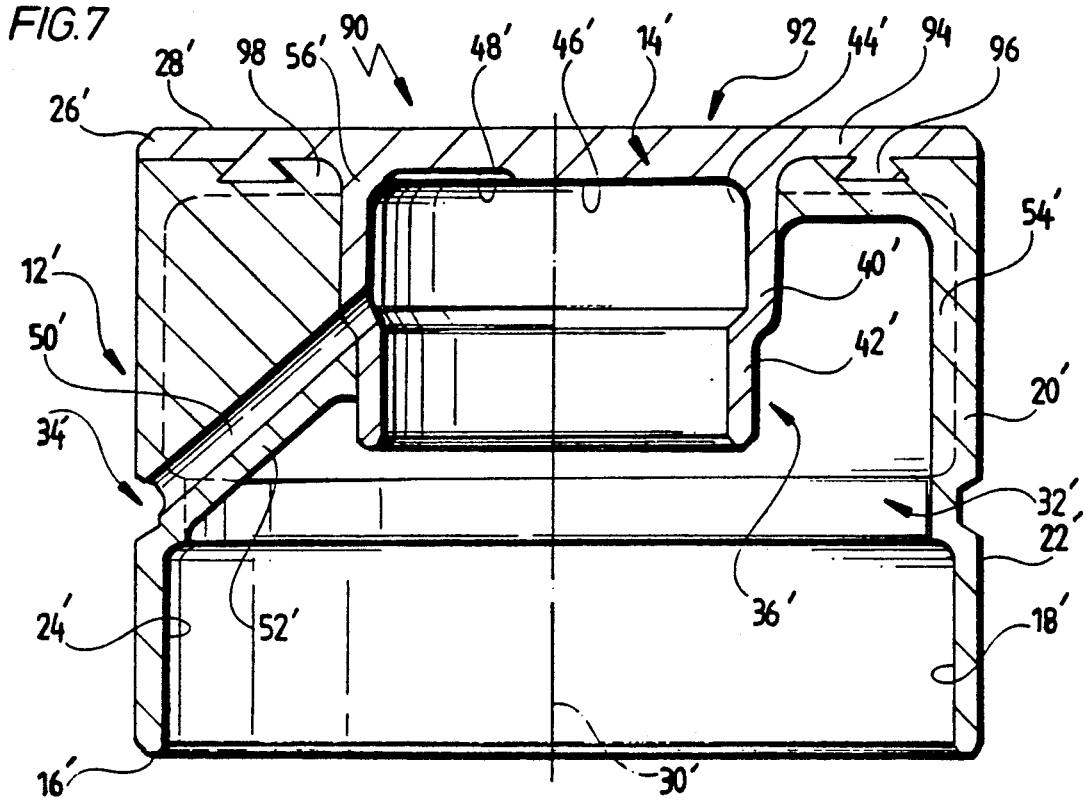
Figure 8:
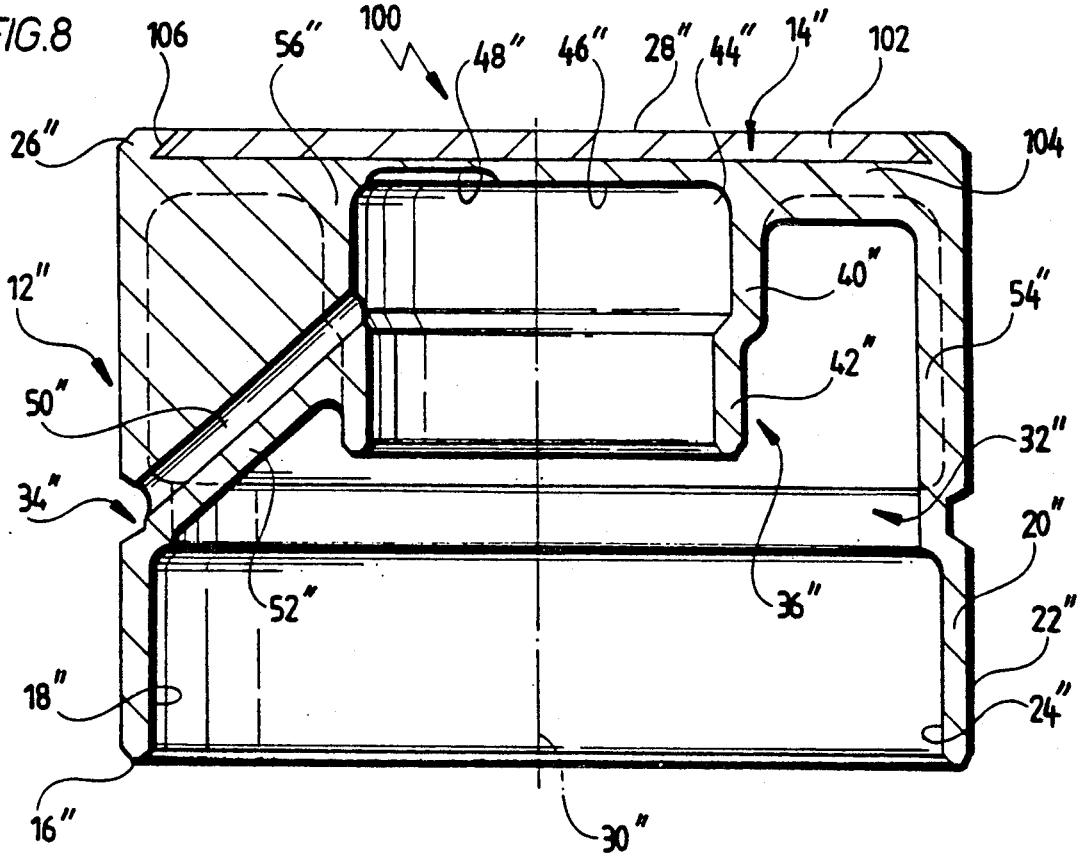

Further features of the invention are set forth in the following description and the appended drawings of several embodiments. The drawings show:

FIG. 1 a section along line 1—1 in FIG. 2 through a first embodiment of a cup tappet body according to the invention;

FIG. 2 a plan view from below of the first embodiment;

FIG. 3 a partial section similar to FIG. 1 through a second embodiment;

FIG. 4 a section similar to FIG. 3 through a third embodiment;

FIG. 5 a section along line 5—5 in FIG. 6 through a fourth embodiment;

FIG. 6 a plan view from below of the sixth embodiment;

FIG. 7 a section similar to FIG. 1 through a fifth embodiment;

FIG. 8 a section similar to FIG. 1 through a sixth embodiment; and

Figure 9:
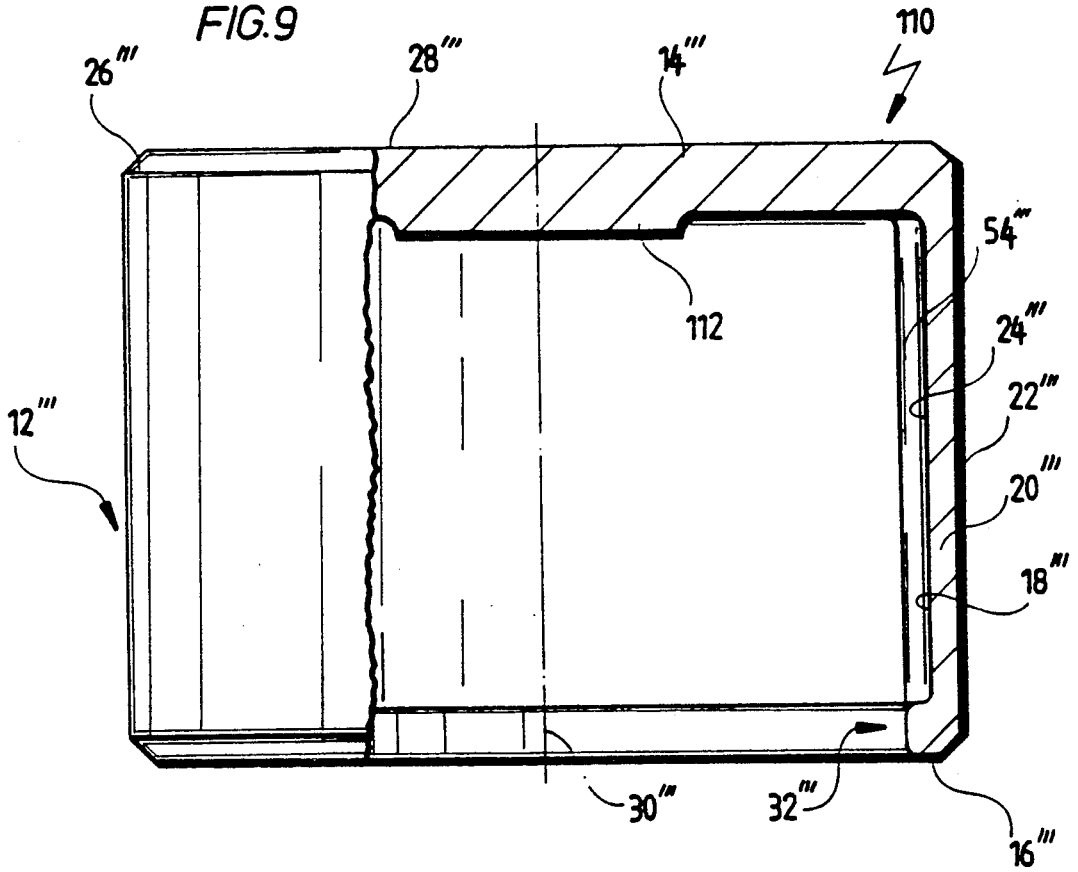

FIG. 9 a section similar to FIG. 1 through a seventh embodiment.

A first embodiment (FIG. 1) of an inventive cup tappet body 10 for valve tappets comprises a cylindrical guide body 12 which is closed at the top by a tappet bottom 14 and has opposite the tappet bottom 14 a bottom opening 18 delimited by a bottom rim 16.

The guide body 12 is preferably of circular-cylindrical shape and so its wall 20 has an outer circumferential surface 22 as outside cylinder surface and an inner circumferential surface 24 as inside cylinder surface.

In the region of a top rim 26, the wall merges integrally into the tappet bottom 14 which preferably has a cam bearing surface 28 standing perpendicularly on a cylinder axis 30 of the guide body 12.

In a central region between the tappet bottom 14 and the bottom rim 16, the guide body 12 has a reinforcing element 32 of bead-like shape. This reinforcing element 32 extends in a plane approximately parallel to the tappet bottom 14, preferably in a plane perpendicular to the cylinder axis 30 and rises as toroidal element from the inner circumferential surface 24 in the direction of the cylinder axis 30. At the same time, the reinforcing element 32 creates on the outer circumferential surface 22 an oil groove 34 which likewise lies in a plane parallel to the reinforcing element 32. Within the scope of the invention, the thickness of the wall 20 is also substantially constant in the region of the reinforcing element 32. In the preferred embodiment shown in FIG. 1, on the one hand, the reinforcing element 32 rises with a trapezoidal cross-section from the inner circumferential surface 24 and, on the other hand, the oil groove 34 is also of trapezoidal cross-section, and both cross-sections are of such configuration that the thickness of the wall 20 remains approximately constant.

A guide cylinder 36 for a hydraulic valve play-compensating element 38, indicated only in dot-and-dash lines, rises from the tappet bottom 14 on the side thereof opposite the cam bearing surface 28 in the direction of the bottom rim 16 and coaxially with the cylinder axis 30. This guide cylinder 36 comprises a base ring 40 immediately adjoining the tappet bottom 14 as well as a guide ring 42 which is carried by the base ring 40 and constitutes the actual guide for the hydraulic valve play-compensating element 38. In the preferred embodiment according to the present invention, the base ring 40 has a larger inside diameter than the guide ring 42 and so owing to the undercut between the guide ring 42 and the tappet bottom 14 an oil chamber 44 is created between the base ring 40 and the hydraulic valve play-compensating element 38.

To enable overflow of the oil from the oil chamber 44 into the hydraulic valve play-compensating element 38, there is provided in a base surface 46 of the guide cylinder 36 arranged parallel to the cam bearing surface 28 and opposite the latter on the tappet bottom 14 an overflow 48 in the form of a recess in this base surface 46 which establishes a connection between the oil chamber 44 and the interior of the hydraulic valve play-compensating element 38. In the simplest case, the overflow 48 may be a recess with a round outer rim. As shown in FIG. 2, the overflow 48 preferably has a substantially four-cornered outer rim.

If the oil is supplied from an external source, an oil duct 50 is provided between the oil groove 34 and the oil chamber 44 for supplying the oil chamber 44 with oil. This oil duct 50 preferably extends in a rib 52 which is drawn up from the tappet bottom 14 and connects the wall 20 with the guide cylinder 36. The rib 52 is drawn up so far that it is capable of completely accommodating the oil duct 50 proceeding from the oil groove 34 and opening into the guide cylinder 36 in the region of transition between base ring 40 and guide ring 42. This rib 52 simultaneously serves as reinforcing rib for reinforcing the entire cup tappet body 10 and, in particular, for reinforcing the wall 20 and the guide cylinder 36 together with the tappet bottom 14.

As shown, in particular, in FIG. 2, in the simplest preferred embodiment, two further reinforcing ribs 54 are also provided. In contrast with the rib 52, however, these reinforcing ribs 54 rise in one piece over their entire length from the tappet bottom 14 and the wall 20 between the reinforcing element 32 and the tappet bottom 14, more particularly, at a height which, in relation to the inner circumferential surface 24, corresponds approximately to the height of the reinforcing element 32 designed as bead. The reinforcing ribs 54 extend as far as into a foot region 56 of the base ring 40.

As may be seen, in particular, from FIG. 2, the reinforcing ribs 54 and also the rib 52 extend in the radial direction in relation to the cylinder axis 30 and, in the simplest case, the rib 52 forms with the reinforcing ribs 54 a total of three reinforcements. As also indicated in dot-and-dash lines in FIG. 2, several reinforcements are preferably provided and so, for example, a total of six reinforcements is also conceivable.

In order to make the inventive cup tappet body 10 as light as possible, undercuts are provided between the reinforcing element 32 and the tappet bottom 14 as well as between the reinforcing ribs, be it reinforcing ribs 54 or rib 52, i.e., the wall 20 of the guide body 12 is brought back to essentially the same thickness as between the reinforcing element 32 and the bottom rim 16. This likewise leads to the cup tappet body having a mass which is as small as possible.

In a second embodiment (FIG. 3) of an inventive cup tappet body, designated in its entirety 60, those parts identical with those of the first embodiment bear the same reference numerals and, therefore, reference is to be had to the statements on the first embodiment for a description of these.

The second embodiment differs from the first only in that the reinforcing ribs 54*a* form a reinforcing triangle between the tappet bottom 14 and the wall 20 of the guide body 12. This reinforcing triangle is drawn up with one of its short sides from the tappet bottom 14 to the reinforcing element 32 and extends with its other short side from the inner circumferential surface 24 of the wall 20 to approximately half way between the latter and the guide cylinder 36. The reinforcing rib 54*a* continues over the remaining part as far as to the foot region 56 of the guide cylinder 36 at a height which corresponds approximately to the height of the reinforcing element 32.

In a third embodiment of the inventive cup tappet body, designated in its entirety 70 and illustrated in FIG. 4, those parts identical with those of the first embodiment bear the same reference numerals and, therefore, reference is likewise to be had to the statements on the first embodiment for a description of these.

In contrast with the first embodiment, the reinforcing rib 54*b* is drawn up just as far from the tappet bottom 14 as the rib 52, i.e., it extends, on the one hand, from the tappet bottom 14 as far as to the reinforcing element 32 and, on the other hand, from the tappet bottom 14 to almost the bottom rim 72 of the guide cylinder 36 and hence fills almost the entire free space between the inner circumferential surface 24 and the guide cylinder 36.

In a fourth embodiment of the inventive cup tappet body, designated in its entirety 80 and illustrated in FIGS. 5 and 6, those parts identical with those of the first embodiment bear the same reference numerals and, therefore, reference is again to be had to the statements on the first embodiment for a description of these.

In contrast with the first embodiment, the reinforcing ribs 54*c* are no longer arranged so as to extend radially in relation to the cylinder axis 30 but instead extend parallel to one another and parallel to a tangent of the outer circumferential surface 22 or of the base ring 40. The reinforcing ribs 54*c* extend as secants to the circular-cylindrical guide body 12 which are offset so far inwards in the direction towards the cylinder axis 30 that they intersect the base ring.

Two such reinforcing ribs 54*c* extending parallel to each other are preferably provided. These rise from the tappet bottom 14 to approximately the level of the base ring 40 and extend at this height between opposite sides of the inner circumferential surface 24. Only the part of the reinforcing rib 54*c* which encloses the oil duct 50 is of thickened configuration and drawn up from the base ring 40 towards an inner circumferential surface as far as to the reinforcing element 32 so the oil duct 50 can branch off from the oil groove 34 as in the above-described embodiments.

All of the embodiments of the above-described cup tappet bodies 10, 60, 70, 80 are in the form of a one-piece casting which is preferably made directly by shaped casting. The shaped casting may be sand casting, precision casting, precision casting in ceramic molds, die-casting, pressure casting or powder metal injection die-casting, and the selected process will depend primarily on the chosen material. In particular, cast iron on the basis of lamellar graphite gray cast iron, spheroidal graphite gray cast iron or malleable cast iron is suitable as material for such a one-piece casting, and this can be either alloyed or unalloyed, In a particularly preferred embodiment, provision is made for the cup tappet body to be of cast iron which has in the region of the tappet bottom a partly or completely metastably solidified structure, i.e., is, for example, partly carbide or chill-cast as the tappet bottom 14 with the cam bearing surface 28 is subjected to the greatest wear, particularly in the case of a cup tappet body for valve tappets with a hydraulic valve play-compensating element where the cam bearing surface 28 is in constant contact with the cam and hence lubricating problems occur between the cam bearing surface 28 and the cam.

Chill-casting is particularly advantageous for the manufacture of a cup tappet body as it permits easy adaptation of the tribological characteristics of the cam bearing surface to cams which may, for example, also be manufactured by casting.

Furthermore, as generally known, the casting may be followed by hardening treatment of the cup tappet body wherein, for example, the cast iron is hardened by heat treatment with phase transition. Thermochemical rim zone hardening of the cast iron or remelt hardening are, however, also conceivable.

In further embodiments of the inventive cup tappet body 10, 60, 70, 80 it is also conceivable for these to be manufactured by casting from steel materials such as case-hardening steels, preferably GS-15 Cr 3, GS-16 Mn Cr 5, GS-21 Ni Cr Mo 2, GS-16 Cr Mo 4 or heat-treatable steels, preferably GS-53 Mn Si 4, GS-42 Cr V 6, GS-42 Cr Mo 4, or nitriding steels, preferably GX 38 Cr Mo V 5 1, GS-31 Cr Mo V 9, GS-34 Cr Al Ni 7, or tool steels, preferably 105 W Cr 6, X 210 Cr W 12 or high-speed steels, preferably S-6-5-2.

Finally, manufacture of a one-piece cup tappet body 10, 60, 70, 80 from light-metal alloys, for example, alloys based on aluminum such as, for example, Al Si 7 Mg, Al Si 17, Al Mg 9 Zn 1, Al Cu 4 Ti Mg or alloys based on titanium, preferably Ti Al 6 V 4, is also conceivable. The light-metal alloys may also be fiber- or whisker-reinforced.

In a further embodiment of the inventive cup tappet body, designated in its entirety 90 and illustrated in FIG. 7, those parts identical with those of the first embodiment bear the same reference numerals but with a' in addition and, therefore, reference is similarly to be had to the statements on the first embodiment for a description of these. In contrast with the first embodiment, the tappet bottom 14' is exemplarily of thicker configuration than in the first embodiment and comprises a semi-finished part, designated in its entirety 92, having a tappet bottom plate 94 which extends over the entire guide body 12', covers the latter and carries the cam bearing surface 28'.

The guide cylinder 36' with the base ring 40 and the guide ring 40' is then integrally molded on this tappet bottom plate 94. The tappet bottom plate 94 also carries on the side thereof opposite the cam bearing surface 28' cast-on elements 96 which are, for example, of dovetail design and permit a positive connection to be made with a bottom part 98 of the tappet bottom 14'. In a similar way, the base ring 40' and the guide ring 42' may also be provided with cast-on elements for the rib 52 or the reinforcing ribs 54. The bottom part 98 of the tappet bottom 14' is again manufactured in one piece with the guide body 12' and the reinforcing ribs 54 as well as with the rib 52 as casting. This casting is cast integrally on the prefabricated semi-finished part 92 and hence joined to the latter by casting to form one unit.

Alternatively, in accordance with the invention, it is also advantageous for the base ring 40' and the guide ring 42' to be cast around in ring-shaped configuration and for the ribs or the reinforcing ribs to extend from this ring.

Manufacture of the cup tappet body 90 is preferably carried out by the semi-finished part 92 which, for its part, is prefabricated by casting or by cutting, being manufactured from the corresponding material and the semi-finished part 92 together with the guide body 12', the reinforcing ribs 54' and the rib 52' being subsequently cast integrally with one another.

The semi-finished part (2 may, in principle, be a semi-finished part which is made from the same materials as cited above in connection with other embodiments. This semi-finished part 92 is preferably made of highly wear-resistant materials in order to guarantee the necessary tribological characteristics of the cam bearing surface 28'. It is, however, also possible for the semi-finished part 92 to be made of hard metal or ceramic materials such as, for example, pure and mixed ceramic material consisting of $ZrO_2$, $AL_2O_3$ and $Si_3N_4$.

In a further embodiment (FIG. 8) of the invention cup tappet body, designated in its entirety 100, those parts identical with those of the first embodiment likewise bear the same reference numerals but with " in addition, and, therefore, reference is to be had to the above statements for a description thereof.

In contrast with the first embodiment, the tappets bottom 14" is likewise of two-part configuration, i.e., the tappet bottom 14" comprises a tappet bottom plate 102 which carries the cam bearing surface 28" and is manufactured as semi-finished part. The tappet bottom plate extends radially in relation to the cylinder axis 30" but not as far as to the outer circumferential surface 22". Instead it is of shorter extent and is arranged in a carrying bottom 104 manufactured in a casting operation with the guide body 12". The carrying bottom 104 embraces the tappet bottom plate 102 at is side rims 106 and terminates flush with it. To this end, the side rims of the tappet bottom plate 102 are preferably likewise inclined in dovetail-like configuration so as to enable positively connected anchoring of the tappet bottom plate 102 in the carrying bottom 104.

The tappet bottom plate 102 may be manufactured in the same manner as the semi-finished part 92 from the same materials as mentioned in connection with the one-piece tappet body 10, 60, 70, 80 and also from hard metal or ceramic materials.

To manufacture the cup tappet body 100, the tappet bottom plate 102 is likewise manufactured as semi-finished part, and the carrying bottom 104 including the guide body 12" and the guide cylinder 36" is then cast in one piece with it in a casting process.

In all embodiments, 10, 60, 70, 80, 90, 100 of the inventive cup tappet body, it was always assumed that the carting was not followed by any forming process apart from the final mechanical machining of the cup tappet body to size. Alternatively, it is, however, for example, conceivable for the reinforcing element 32 to be manufactured in the course of a forming process following the casting by, for example, rolling-in of a bead.

Insofar as a further example of an inventive cup tappet body, designated in its entirety 110 and illustrated in FIG. 9, is identical with the first embodiment, it bears the same reference numerals with ''' in addition, and, therefore, reference is to be had to the statements on the first embodiment for a description of these parts.

In contrast with the first embodiment, there is no guide cylinder 36 as element for holding the valve support, but merely a valve-supporting pin 112 rising from the tappet bottom 14 so the cup tappet body 110 does not serve to accommodate a hydraulic valve play-compensating element but is used as mechanical cup tappet.

Furthermore, the reinforcing element 32''' is not arranged approximately half-way between the tappet bottom 14''' and the bottom rim 16''' but in the region of the bottom rim 16''' and serves to reinforce the latter, in particular to facilitate machining of the cup tappet body 110 following the casting.

In the cup tappet body 110, there is no rib 52 and the oil groove 34 is also dispensed with.

If the valve-supporting pin 112 exceeds a certain height, it is advantageous for the cup tappet body to be provided with a rib 54.

In exactly the same way as the embodiments 10, 60, 70, 80 of the inventive cup tappet body, the cup tappet body 110 is manufactured in one piece from the same materials and in accordance with the same processes as the cup tappet body 10, 60, 70, 80.

It is, however, also conceivable for the tappet bottom to be of similar design to that of the cup tappet body 100 or for the valve-supporting pin 112 to be formed integrally on a simi-finished part similar to the cup tappet body 90.

In these cases, the same materials are then used for the semi-finished parts as in the cup tappet bodies 90 and 100.

The present disclosure relates to the subject matter disclosed in german application No. P 39 20 729.3 of Jun. 24, 1989, the entire specification of which is incorporated herein by reference.

What is claimed is:

1. Cup tappet body for valve tappets comprising a cylindrical guide body, a tappet bottom and an element carried by said tappet bottom for holding a valve support and being surrounded by said guide body, said element for holding said valve support being cast as one piece with said tappet bottom, and said guide body being a separate piece that is attached to the tappet bottom by solidified material from said cast one piece forming an integral cast connection with the guide body.

2. Cup tappet body for valve tappets comprising a cylindrical guide body, an element cast in one piece with said guide body for holding a valve support and being surrounded by said guide body, and a separate tappet bottom, said guide body and said tappet bottom being manufactured as an integral cast connection by placing said tappet bottom adjacent said guide body when said element for holding said valve support and said guide body are being cast.

3. Cup tappet body for valve tappets comprising a cylindrical guide body, a tappet bottom having a first part carrying an element for holding a valve support surrounded by said guide body and a second part forming a cam bearing surface, said element for holding said valve support being cast in one piece with said first part of said tappet bottom, said guide body being a separate piece that is attached to said first part of said tappet bottom by solidified material from said cast one piece forming an integral cast connection with the guide body.

4. Cup tappet body for valve tappets comprising a cylindrical guide body, a tappet bottom and an element carried by said tappet bottom for holding a valve support, said guide body and said tappet bottom being manufactured as an integral cast connection wherein said guide body is manufactured as a casting in the course of a casting operation that forms said guide body and connects it to a separate unitary piece comprising said tappet bottom and said element for holding said valve support.

5. Cup tappet body for valve tappets comprising a cylindrical guide body, a tappet bottom comprising a semi-finished part and an element carried by said tappet bottom for holding a valve support, said guide body and said tappet bottom being manufactured as an integral cast connected part wherein said guide body is integrally cast on said tappet bottom comprising a semi-finished part during the course of a casting operation.

6. Cup tappet body as defined in claim 5, characterized in that said semi-finished part is designed for integral casing on the cast-on side in a positively connected manner.

7. Cup tappet body as defined in claim 5, characterized in that said element for holding said valve support is prefabricated together with said semi-finished part.

8. Cup tappet body as defined in claim 3, characterized in that the casting of said element for holding said valve support is carried out in the course of the casting operation for joining said guide body and tappet bottom.

9. Cup tappet body as defined in claim 2, characterized in that said guide body comprises a reinforcing element extending circumferentially in a plane parallel to said tappet bottom.

10. Cup tappet body as defined in claim 9, characterized in that said guide body comprises between said reinforcing element and said tappet bottom an undercut adjoining said reinforcing element.

11. Cup tappet body as defined in claim 9, characterized in that said guide body has an oil groove on its outer circumferential surface at the level of said reinforcing element.

12. Cup tappet body as defined in claim 9, characterized in that said reinforcing element is arranged in a central region between said tappet bottom and a free rim of said guide body located opposite said tappet bottom.

13. Cup tappet body as defined in claim 9, characterized in that said reinforcing element is integrally connected with said guide body.

14. Cup tappet body as defined in claim 1, characterized in that said guide body has a reinforcing rib cast integrally thereon and extending in a plane parallel to its cylinder axis.

15. Cup tappet body as defined in claim 14, characterized in that said reinforcing rib extends in the radial direction in relation to said cylinder axis of said guide body.

16. Cup tappet body as defined in claim 14, characterized in that said reinforcing rib extends parallel to a tangential direction of said outer circumferential surface of said guide body.

17. Cup tappet body as defined in claim 14, characterized in that said reinforcing rib extends over said tappet bottom as far as to said element for holding said valve support.

18. Cup tappet body as defined in claim 14, characterized in that said reinforcing rib extends from said reinforcing element over said inner circumferential surface of said guide body.

19. Cup tappet body as defined in claim 17, characterized in that said reinforcing rib has a substantially constant height.

20. Cup tappet body as defined in claim 14, characterized in that said reinforcing rib rises between said element for holding said valve support and said inner circumferential surface of said guide body over said tappet bottom to at most approximately the level of said element holding said valve support.

21. Cup tappet body as defined in claim 14, characterized in that said reinforcing rib extends at the inner circumferential surface of said guide body from said tappet bottom to at least said reinforcing element.

22. Cup tappet body as defined in claim 14, characterized in that said reinforcing rib forms between said tappet bottom and said guide body a reinforcing triangle which is connected with both of these.

23. Cup tappet body as defined in claim 14, characterized in that said reinforcing rib rises over its entire length from said inner circumferential surface of said guide body in one piece with the latter.

24. Cup tappet body as defined in claim 17, characterized in that said reinforcing rib rises over its entire length from said tappet bottom in one piece with the latter.

25. Cup tappet body as defined in claim 14, characterized in that said reinforcing rib rises from said tappet bottom by approximately the same height as said reinforcing element from said inner circumferential surface of said guide body.

26. Cup tappet body as defined in claim 1, characterized in that said element for holding said valve support is a valve-supporting pin rising from said tappet bottom.

27. Cup tappet body as defined in claim 1, characterized in that said element for holding said valve support is a guide cylinder for a hydraulic valve play-compensating element.

28. Cup tappet body as defined in claim 27, characterized in that said guide cylinder is radially extended on said tappet bottom side and forms an oil chamber.

29. Cup tappet body as defined in claim 28, characterized in that said oil chamber is provided with an oil duct extending towards said outer circumferential side of said guide body.

30. Cup tappet body as defined in claim 29, characterized in that said oil duct extends through a reinforcing rib.

31. Cup tappet body as defined in claim 28, characterized in that said guide cylinder forms on its side remote from said tappet bottom a guide ring for said valve play-compensating element and comprises between said guide ring and said tappet bottom a base ring of larger inside and outside diameter than said guide ring for carrying said guide ring so that said oil chamber is created between said base ring and said valve play-compensating element.

32. Cup tappet body as defined in claim 1, characterized in that said cast part of said cup tappet body is made of cast iron.

33. Cup tappet body for valve tappets comprising a cylindrical guide body, a tappet bottom and an element carried by said tappet bottom for holding a valve support and being surrounded by said guide body; said guide body, said tappet bottom and said element for holding said valve support being made of cast iron and manufactured as an integral cast connection; said cast iron comprising at least in the region of said tappet bottom a partly or completely metastably solidified structure.

34. Cup tappet body as defined in claim 33, characterized in that said cast iron is thermally or thermochemically hardened.

35. Cup tappet body as defined in claim 1, characterized in that said cast part of said cup tappet body is cast from steel material.

36. Cup tappet body as defined in claim 1, characterized in that said cast part of said cup tappet body is cast from a light-metal alloy.

37. Cup tappet body as defined in claim 36, characterized in that said light-metal alloy is fiber- or whisker-reinforced.

38. Cup tappet body as defined in claim 5, characterized in that said semi-finished part is made of steel material.

39. Cup tappet body as defined in claim 5, characterized in that said semi-finished part is made of ceramic material.

40. Cup tappet body as defined in claim 5, characterized in that said semi-finished part is made of hard metal.

41. Cup tappet body as defined in claim 1, characterized in that said cast part of said cup tappet body is manufactured by shaped casting.

42. Cup tappet body as defined in claim 40, characterized in that said cast part of said cup tappet body is manufactured by powder metal injection die-casting.

43. Cup tappet body for valve tappets as defined in claim 1, characterized in that the entire cup tappet body is cast with a substantially finished contour.

44. Cup tappet body as defined in claim 2, characterized in that a part of said cup tappet body is manufactured as a semi-finished part with a substantially finished contour and said cup tappet body is manufactured as a compound casting by integral casting of the other parts of said cup tappet body on said semi-finished part, thereby producing a substantially finished contour.

45. Cup tappet body as defined in claim 43, characterized in that said cup tappet body is manufactured with an almost finished contour.

46. Cup tappet body as defined in claim 43, characterized in that said cup tappet body is manufactured by forming with an almost finished contour following the casting.

* * * * *